United States Patent [19]

Martinez

[11] 4,172,406

[45] Oct. 30, 1979

[54] AUDIO-VISUAL HEADPHONES

[76] Inventor: Rosa E. Martinez, 1034 Shadwell, San Antonio, Tex. 78228

[21] Appl. No.: 951,489

[22] Filed: Oct. 16, 1978

[51] Int. Cl.[2] ..... A63J 17/00

[52] U.S. Cl. ..... 84/464 R

[58] Field of Search ..... 84/464; 353/15; 362/86, 362/87, 105, 106, 811; 179/1 SP

[56] References Cited

U.S. PATENT DOCUMENTS

| | | | |
|---|---|---|---|
| 3,205,755 | 9/1965 | Sklar | 84/464 |
| 3,598,889 | 8/1971 | Switsen | 84/464 |
| 3,623,392 | 11/1971 | Boyer | 84/464 |
| 4,117,265 | 9/1978 | Gerlach | 179/1 SP |

*Primary Examiner*—L. T. Hix
*Assistant Examiner*—Benjamin R. Fuller
*Attorney, Agent, or Firm*—Daniel Jay Tick

[57] ABSTRACT

A pair of headphones has a right speaker for the right ear and a left speaker for the left ear of the user. The speakers are electrically connected to each other and to a sound input source whereby the speakers reproduce sound from the sound input source. A pair of goggles is coupled to the headphones and covers the eyes of the user. A plurality of lamps are provided in the goggles, visible to the user. A microphone is electrically connected in circuit with a source of electrical energy and the lamps whereby sound reproduced by the speakers is picked up by the microphone, converted into electrical energy which varies in intensity with variations in the sound, and varies the energization of the lamps to provide a light pattern which varies in accordance with variations in the sound.

1 Claim, 3 Drawing Figures

AUDIO-VISUAL HEADPHONES

BACKGROUND OF THE INVENTION

The present invention relates to audio-visual headphones. More particularly, the invention relates to audio-visual headphones for providing a user with sound from a sound input source and simultaneously providing the user with visual light in a pattern varying in accordance with variations in the sound.

Objects of the invention are to provide audio-visual headphones of simple structure, which are inexpensive in manufacture, used with facility and convenience in the same manner as ordinary earphones, and functions efficiently, effectively and reliably to provide for the complete relaxation of a user by eliminating all external sight and sound and substituting therefor desired sound, preferably music, and visual patterns which vary in accordance with the variation of the sound.

Audio-visual devices are disclosed in the following United States patents. U.S. Pat. No. 3,598,889, issued Aug. 10, 1971 to Switsen, U.S. Pat. No. 3,623,392, issued Nov. 30, 1971 to Boyer, U.S. Pat. No. 3,671,117, issued June 20, 1972 to Tibbets, U.S. Pat. No. 3,749,483, issued July 31, 1973 to Lowe, U.S. Pat. No. 3,794,779, issued Feb. 26, 1974 to Greuzerd et al and U.S. Pat. No. 3,891,810, issued June 24, 1975 to Hayashi.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
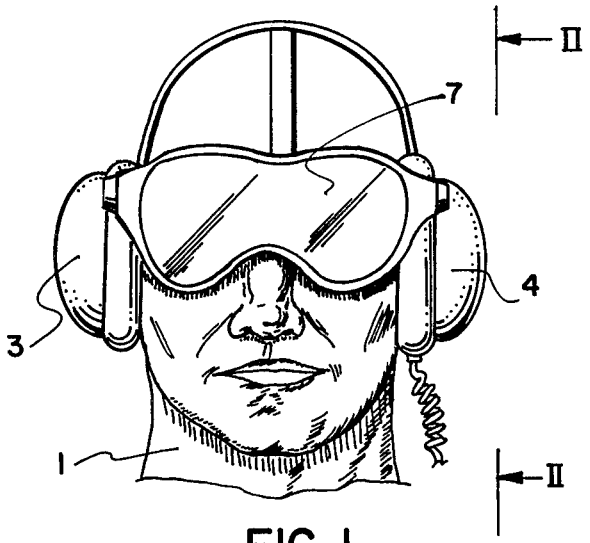
FIG. 1 is a front view of an embodiment of the audio-visual headphones of the invention in use.
Figure 2:
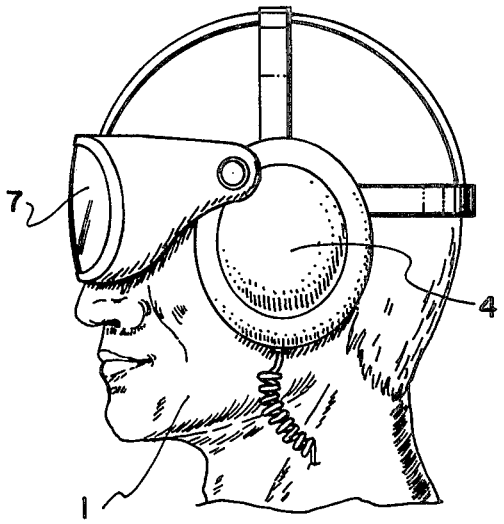
FIG. 2 is a side view, taken along the lines II—II, of FIG. 1.
Figure 3:
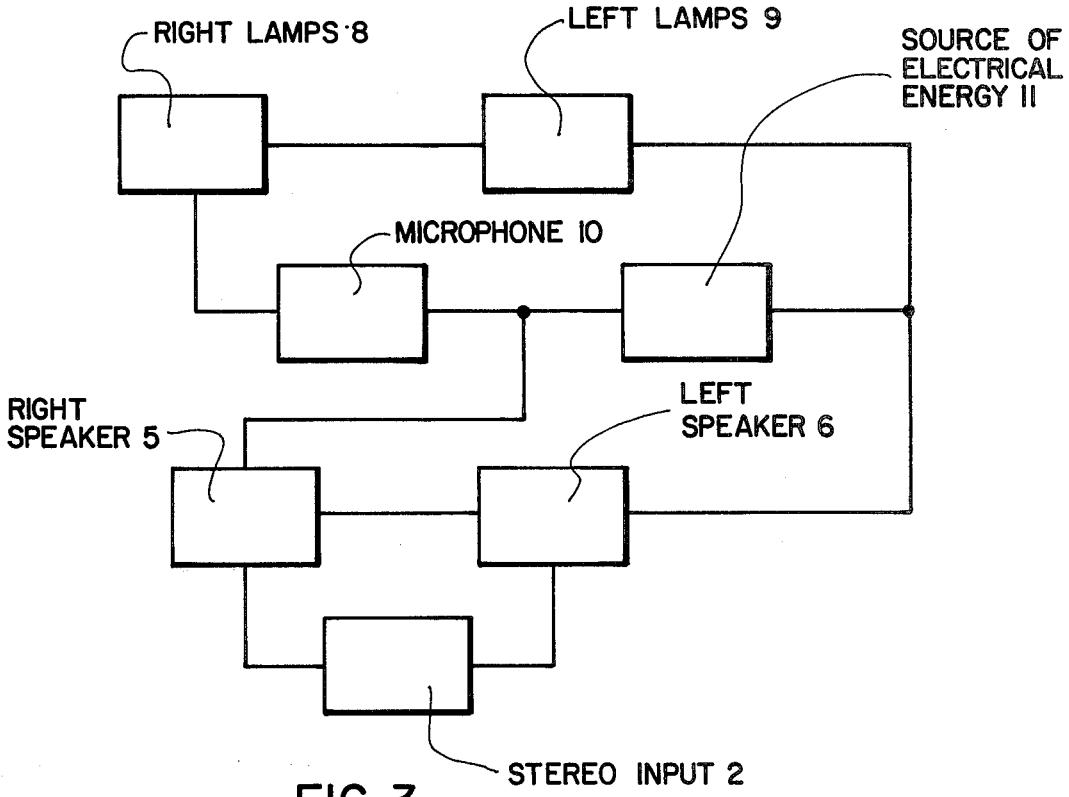
FIG. 3 is a block diagram of the audio-visual headphones of the invention.

The audio-visual headphones of the invention provide a user 1 (FIGS. 1 and 2) with sound from a sound input source 2 (FIG. 3). The audio-visual headphones of the invention simultaneously provide the user 1 with visible light in a pattern varying in accordance with variations in the sound provided by the sound input source or stereo input 2.

The headphones of the invention comprise a pair of headphones 3 and 4 (FIG. 1) having a right speaker 5 (FIG. 3) for the right ear of the user 1 and a left speaker 6 (FIG. 3) for the left ear of the user. The speakers 5 and 6 are electrically connected to each other and to the sound input source 2, as shown in FIG. 3, whereby the speakers reproduce sound from the sound source.

A pair of goggles 7 (FIGS. 1 and 2) cover the eyes of the user 1 and are coupled to the headphones 3 and 4. The goggles 7 have a plurality of lamps therein visible to the user 1. The lamps include right lamps 8 (FIG. 3) in the area of the right eye of the user and left lamps 9 (FIG. 3) in the area of the left eye of the user.

A microphone 10 (FIG. 3) of any suitable type is electrically connected in circuit with a source of electrical energy 11 of any suitable type (FIG. 3) and the lamps 8 and 9, as shown in FIG. 3. Thus, sound reproduced by the speakers 5 and 6 is picked up by the microphone 10, converted by said microphone into electrical energy which varies in intensity with variations in the sound, and varies the energization of the lamps 8 and 9, to provide a light pattern which varies in accordance with variations in the sound.

The user 1 thus hears the desired sound, preferably in the form of soothing music, and sees light patterns which vary in accordance with variations in the sound.

While the invention has been described by means of a specific example and in a specific embodiment, I do not wish to be limited thereto, for obvious modifications will occur to those skilled in the art without departing from the spirit and scope of the invention.

I claim:

1. Audio-visual headphones for providing a user with sound from a sound input source and simultaneously providing the user with visible light in a pattern varying in accordance with variations in the sound, said headphones comprising a pair of headphones having a right speaker for the right ear of the user and a left speaker for the left ear of the user, said speakers being electrically connected to each other and to a sound input source whereby said speakers reproduce sound from said sound input source;

a pair of goggles for covering the eyes of the user, said goggles being coupled to said headphones and having a plurality of lamps therein visible to said user;

a source of electrical energy;

a microphone electrically connected in circuit with the source of electrical energy and said lamps whereby sound reproduced by said speakers is picked up by the microphone, converted into electrical energy which varies in intensity with variations in the sound, and varies the energization of said lamps to provide a light pattern which varies in accordance with variations in the sound.

* * * * *